United States Patent [19]

Im

[11] 4,265,741

[45] May 5, 1981

[54] APPARATUS AND METHOD FOR SEPARATING DIVERSE PARTICLES OF A SLURRY

[76] Inventor: Chang J. Im, Rte. 6, Box 30, Abingdon, Va. 24210

[21] Appl. No.: 149,990

[22] Filed: May 15, 1980

[51] Int. Cl.[3] ..... B04C 5/081; B04C 5/107

[52] U.S. Cl. ..... 209/211; 210/220

[58] Field of Search ..... 209/144, 211; 210/220, 210/512 R, 512 M; 55/449, 459 R, 459 A, 459 B, 459 C, 459 D, 476

[56] References Cited

U.S. PATENT DOCUMENTS

| | | | |
|---|---|---|---|
| 1,214,249 | 1/1917 | Williams | 209/144 |
| 2,379,411 | 7/1945 | Berges | 210/512 R X |
| 3,135,684 | 6/1964 | Ackeret et al. | 209/144 |
| 3,289,894 | 12/1966 | Leeman | 209/211 X |
| 4,134,828 | 1/1979 | Trawinski | 209/211 |
| 4,212,653 | 7/1980 | Giles | 209/144 X |

*Primary Examiner*—William A. Cuchlinski, Jr.

*Attorney, Agent, or Firm*—Douglas N. Larson

[57] ABSTRACT

An apparatus for separating lightweight particles from heavyweight and middling particles of the slurry generally consisting of means defining an upper cylindrical chamber, means defining a frusto-conical chamber communicating an upper end thereof with a lower end of the upper cylindrical chamber, means for tangentially injecting the slurry into the upper end of the upper cylindrical chamber to create a swirling vortex of the slurry, descending through the upper cylindrical chamber and the frusto-conical chamber, providing an axially disposed, low pressure zone, means for discharging an overflow of the slurry containing lightweight particles, the overflow discharging means including an intake orifice disposed in communication with the low pressure zone in the frusto-conical chamber and means for discharging an underflow of the slurry containing heavyweight and middling particles, the underflow discharging means having an intake orifice communicating with the frusto-conical chamber.

30 Claims, 3 Drawing Figures

APPARATUS AND METHOD FOR SEPARATING DIVERSE PARTICLES OF A SLURRY

In the prior art, and particularly in the mining industry, such as the coal industry, devices known as hydrocyclones have been used to separate lightweight particles from middling and heavyweight particles of a slurry. Typically, a hydrocyclone includes an upper cylindrical chamber, a lower, inverted conical chamber having an axially disposed discharge orifice and a finder or vortex tube disposed axially in the upper cylindrical chamber and projecting downwardly into the upper end of the inverted conical chamber. The slurry containing the particles to be separated is tangentially injected into the upper end of the upper cylinder to create a swirling vortex of the slurry descending through the upper cylindrical chamber and the inverted conical chamber, and an axially disposed vortex of air ascending through the inverted, conical chamber into the vortex or finder tube.

In the descending vortex, the particles are separated by centrifugal forces applied to the particles, in the conventional manner. Theoretically, the middling and heavyweight particles are caused to migrate to the outer sides of the chambers and eventually are discharged through the orifice in the lower end of the inverted, conical chamber. The lightweight particles, particularly in the annular zone in the vicinity of the lower end of the vortex tube are aspirated by the ascending vortex of air and are discharged through the vortex tube.

In the use of the type of hydrocyclone as described, it has been found that the presence of descending and ascending vortices in a single chamber creates a dead zone in which there are middling particles which have a tendency to become entrapped in the stronger ascending vortex, thus contaminating the overflow and decreasing the quality of the lightweight particles sought to be extracted from the slurry. Most manufacturers of conventional hydrocyclones have sought to overcome the adverse effects of the entrapment of middling particles in the dead zone by the ascending vortex by providing for mechanical adjustment of the physical interrelationships of the hydrocyclone components to minimize the dead zone and thereby provide a more definitive separation. In particular, they have sought to provide for the adjustment of the spacing between the lower end of the vortex or finder tube and the wall of the inverted, conical chamber, and to provide means for adjusting the size of the underflow orifice at the lower end of the inverted, conical chamber. While such adjustment provisions in conventional hydrocyclones have served to improve the quality of the overflow material, it has been found that the quality of the overflow material is not optimal, the adjustment features of such devices contribute to increased manufacturing costs and more complex operation of such devices, and that the adjustment of such devices cannot be made during operation of the devices.

According, it is the principal object of the present invention to provide an improved apparatus for separating heavyweight particles from middling and heavyweight particles of a slurry.

Another object of the present invention is to provide an improved apparatus for separating lightweight particles from middling and heavyweight particles in a slurry in which the overflow material including the lightweight particles is contaminated with a minimal amount of middling particles.

A further object of the present invention is to provide an improved apparatus of separating lightweight particles from middling and heavyweight particles of a slurry in which the interrelationships of the components thereof may be adjusted to provide for a more precise separation of the particles.

A still further object of the present invention is to provide an improved apparatus for separating lightweight particles from middling and heavyweight particles of a slurry in which the interrelationship of the components thereof may be adjusted while the apparatus is in operation to provide for a more precise separation of the particles.

Another object of the present invention is to provide an improved apparatus for separating lightweight particles from middling and heavyweight particles of a slurry which is comparatively simple in design, relatively inexpensive to manufacture and highly effective in performance.

A further object of the present invention is to provide a novel method of separating lightweight particles from middling and heavyweight particles of a slurry.

A still further specific object of the present invention is to provide a novel apparatus and method for separating coal particles from a slurry containing the coal particles and other materials.

Other objects and advantages of the present invention will become more apparent to those persons having ordinary skill in the art to which the present invention pertains from the following description taken in conjunction with the accompanying drawing wherein.

Figure 1:
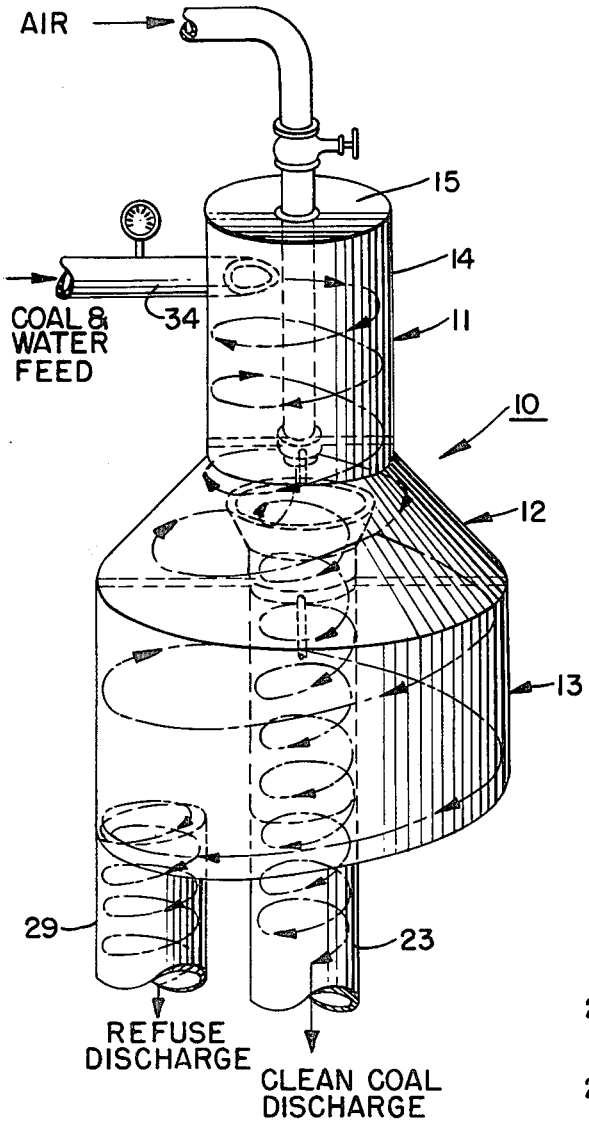
FIG. 1 is a perspective view of an embodiment of the invention.
Figure 3:
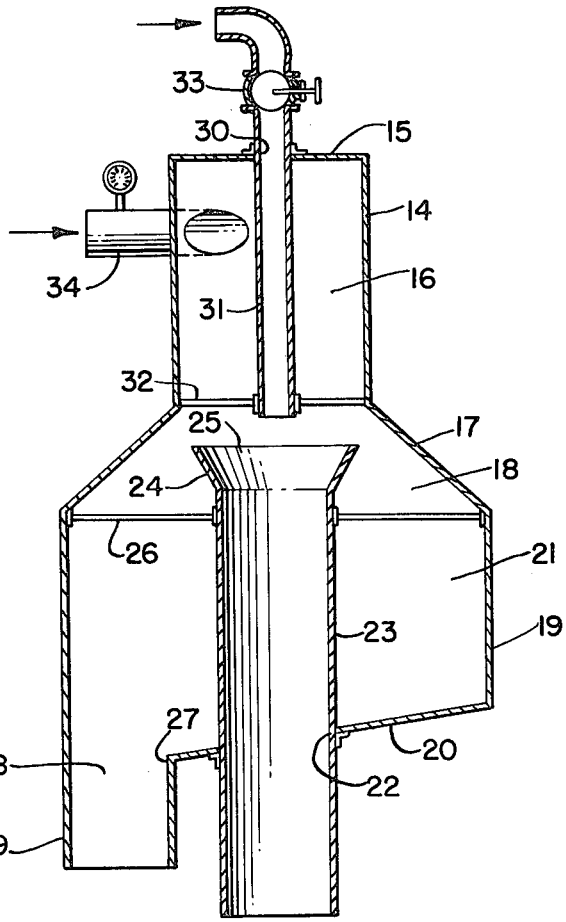
FIG. 3 is a cross-sectional view taken along line 3—3 in FIG. 2.

Referring to the drawing, there is illustrated a particle separating apparatus 10 including an upper section 11, a middle section 12 and a lower section 13. Upper section 11 consists of a cylindrical wall 14 and an upper wall 15 defining an upper cylindrical chamber 16. Middle section 12 consists of a frusto-conical wall 17 defining a frusto-conical chamber 18 communicating at its upper end with the lower end of upper cylindrical chamber 16. Lower section 13 consists of a cylindrical wall 19 and a sloping bottom wall 20 defining a lower cylindrical chamber 21.

Bottom wall 20 of the lower section is provided with an axially disposed opening 22 in which there is mounted an axially disposed overflow discharge conduit 23. Conduit 23 extends through lower cylindrical chamber 21 and is provided with an upper, annular flaring portion 24 disposed in frusto-conical chamber 18 and defining an axially disposed overflow intake orifice 25. The upper end of conduit 23 is supported by a set of spaced, radially disposed braces 26. Bottom wall 20 of the lower section also is provided with an opening 27 at the lower end thereof, offset radially relative to the axis of lower cylindrical chamber 21, which defines an intake orifice 28 communicating with an underflow discharge conduit 29.

Upper wall 15 of the upper section is provided with an axially disposed opening 30 in which there is mounted an axially disposed conduit 31. The lower end of conduit 31 projects slightly into the upper end of frusto-conical chamber 18, just above overflow intake orifice 25. The lower end of conduit 31 is supported by a set of spaced, radially disposed braces 32. Conduit 31 is connected at its outer end to a source of fluid under pressure, preferably compressed air. The rate of flow of such fluid through conduit 31 into the separating device may be adjusted by means of a valve 33 provided in the conduit above the upper section of the apparatus.

Figure 2:
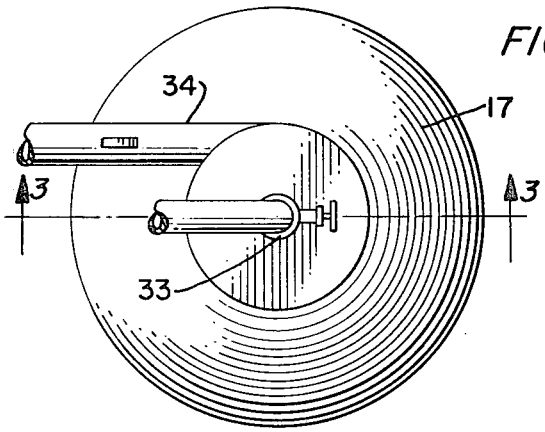
FIG. 2 is a top plan view of the embodiment shown in FIG. 1.

A slurry containing the particles to be separated is injected tangentially into the upper end of the upper cylindrical chamber 16 by means of an inlet conduit 34 disposed tangentially relative to cylindrical wall 14 as best illustrated in FIG. 2.

In the operation of the apparatus as described, a slurry containing the particles to be separated is injected tangentially into the upper end of upper cylindrical chamber 16 through inlet conduit 34. Such slurry may consists, as an example, a mixture of coal, impurities and water. As the slurry is injected into chamber 16 at a high velocity, it impinges on the inner side of cylindrical wall 14 and produces a swirling vortex of slurry descending through upper cylindrical chamber 16, frusto-conical chamber 18 and lower cylindrical chamber 19, as shown in FIG. 1. Simultaneously, the descending vortex will create a low-pressure core. As the slurry descends in a vortex, centrifugal forces acting on the particles will cause the middling and heavier particles to migrate outwardly. Eventually, the slurry containing such particles will flow along bottom wall 20 and through intake orifice 28 to be discharged through underflow discharge conduit 29.

As the middling and heavyweight particles are caused to migrate outwardly, the lightweight particles at the inner zone of the vortex, in the frusto-conical chamber adjacent intake orifice 25, will be aspirated and caused to flow inwardly through intake orifice 25 into overflow discharge conduit 23. The annular flared portion 24 of overflow discharge conduit 23 functions to enhance the collection of lightweight particles in the inner zone of the slurry by physically diverting such particles through intake orifice 25 into the overflow discharge conduit.

For certain materials, the low pressure core developed by the descending vortex may be sufficient to aspire lightweight particles in the inner zone of the descending vortex and cause them to migrate through orifice 25 into the overflow discharge conduit. Where the aspirating action of the low pressure core developed by the vortex is insufficient or where it is desired to enhance the aspirating action of the low pressure core, a stream of high velocity air may be injected into orifice 25 through conduit 31. Under such conditions, the lightweight particles in the inner zone of the descending vortex will more readily be aspired and carried by the stream of high velocity fluid through intake orifice 25 into overflow discharge conduit 23.

Although overflow discharge conduit 23 is shown in a fixed position, rigidly mounted on bottom wall 20 in the drawing, it is to be understood that such conduit can be mounted on the apparatus so that it is adjustable axially. In addition, although the upper end of the overflow discharge conduit is shown as provided with an annular flared portion, any type of end portion configuration can be provided to enhance the aspiration action of the apparatus. In addition, it will be appreciated that valve 33 can be operated to adjust the flow rate of the stream of high velocity air injected into intake orifice 25. For most applications, fluid injection conduit 31 will be connected to a source of compressed air and valve 33 will be used to adjust the flow rate of the compressed air.

While the apparatus as described is in operation, if it is determined by a sampling of the overflow discharge that a poor quality of overflow material is being obtained, the apparatus can be adjusted simply by operating valve 33 to adjust the aspirating action of the device used to separate the lightweight particles from the descending vortex. Such adjustment in the operation of the apparatus can be performed while the apparatus is operating, thus avoiding the necessity of stopping the operation of the apparatus and incurring wasted down time. In addition, in modified forms of the apparatus utilizing an axially adjustable overflow discharge conduit, such conduit can be adjusted axially while the apparatus is in service thus providing a further means of adjusting the aspirating action of the apparatus. In this regard, it will be appreciated that by axially adjusting overflow discharge conduit 23, intake orifice 25 can be repositioned to more effectively receive lightweight particles aspirated from the inner zone of the descending vortex.

Normally, where the raw material being processed is of a substantially constant constituency, the apparatus may be designed to accomodate such a material and little if any adjustment to the components would be necessary to provide an effective separation of the materials. However, whenever the constituency of the material being processed might vary, the adjusting features of the apparatus permit the operating parameters of the apparatus to be adjusted while in service to accomodate such changes in the constituency of the material.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An apparatus for separating lightweight particles from heavyweight and middling particles of a slurry comprising means defining an upper cylindrical chamber, means defining a frusto-conical chamber communicating at an upper end thereof with a lower end of said upper cylindrical chamber, means for tangentially injecting said slurry into an upper end of said upper cylindrical chamber to create a swirling vortex of said slurry descending through said upper cylindrical chamber and said frusto-conical chamber, providing an axially disposed, low pressure zone, means for discharging an overflow of said slurry containing said lightweight particles, said overflow discharging means including an intake orifice disposed in communication with said low pressure zone in said frusto-conical chamber and means for discharging an underflow of said slurry containing said heavyweight and middling particles, said underflow discharging means having an intake orifice communicating with said frusto-conical chamber.

2. An apparatus according to claim 1 wherein said intake orifice of said overflow discharging means is disposed adjacent the junction between said upper cylindrical chamber and said frusto-conical chamber.

3. An apparatus according to claim 1 wherein said overflow discharging means is provided with a flared baffle portion defining said intake orifice thereof for diverting an inner zone of the descending vortex of said slurry into said intake orifice.

4. An apparatus according to claim 1 wherein said intake orifice of said overflow discharging means is adjustable axially.

5. An apparatus according to claim 1 wherein said overflow discharging means comprises an axially disposed conduit.

6. An apparatus according to claim 5 wherein the intake orifice of said overflow discharging conduit is disposed adjacent the junction of said upper cylindrical chamber and said frusto-conical chamber.

7. An apparatus according to claim 5 wherein an upper end of said overflow conduit is provided with a flared baffle portion defining the intake orifice thereof for diverting an inner zone of the descending vortex of said slurry into said overflow discharging conduit.

8. An apparatus according to claim 5 wherein said overflow discharging conduit is adjustable axially.

9. An apparatus according to claim 1 wherein the intake orifice of said underflow discharging means is offset radially relative to the axis of said frusto-conical chamber.

10. An apparatus according to claim 1 including means defining a lower cylindrical chamber having an upper end thereof communicating with a lower end of said frusto-conical chamber.

11. An apparatus according to claim 10 wherein said means defining the lower cylindrical chamber includes a bottom wall disposed at an acute angle relative to the axis of said lower cylindrical chamber.

12. An apparatus according to claim 11 wherein the intake orifice of said underflow discharging means is disposed at a lower side of said bottom wall, offset from the axis of said lower cylindrical chamber.

13. An apparatus according to claim 1 including means for injecting a high velocity stream of fluid into the intake orifice of said overflow discharging means for aspirating an inner zone of the descending vortex of said slurry.

14. An apparatus according to claim 13 including means for adjusting the flow rate of said stream of fluid injected into the intake orifice of said overflow discharging means.

15. An apparatus according to claim 13 wherein the intake orifice of said overflow discharging means is disposed adjacent to the junction of said upper cylindrical chamber and said frusto-conical chamber.

16. An apparatus according to claim 13 wherein said overflow discharging means is provided with a flared baffle portion defining the intake orifice thereof for diverting an inner zone of the descending vortex of said slurry into said overflow discharging means.

17. An apparatus according to claim 13 wherein the intake orifice of said overflow discharging means is adjustable axially.

18. An apparatus according to claim 13 wherein said overflow discharging means comprises an axially disposed conduit.

19. An apparatus according to claim 18 wherein the intake orifice of said overflow discharging conduit is disposed adjacent to the junction of said upper cylindrical chamber and said frusto-conical chamber.

20. An apparatus according to claim 18 wherein said overflow discharging conduit is provided with a flared, annular baffle portion defining the intake orifice thereof for diverting an inner zone of the descending vortex of said slurry into said overflow discharging conduit.

21. An apparatus according to claim 18 wherein said overflow discharging conduit is adjustable axially.

22. An apparatus according to claim 13 wherein the intake orifice of said underflow discharging means is offset radially relative to the axis of said frusto-conical chamber.

23. An apparatus according to claim 13 including means defining a lower cylindrical chamber having an upper portion thereof communicating with a lower portion of said frusto-conical chamber.

24. An apparatus according to claim 23 wherein said means defining a lower cylindrical chamber includes a bottom wall disposed at an acute angle relative to the axis of said lower cylindrical chamber.

25. An apparatus according to claim 24 wherein the intake orifice of said underflow discharging means is disposed at a lower side of said bottom wall, offset from the axis of said lower cylindrical chamber.

26. A method of separating lightweight particles from heavyweight and middling particles of a slurry comprising producing a descending vortex having a constant radius for a predetermined axial distance in the direction of flow and an increasing radius thereafter, aspirating an inner zone of said descending vortex at a region where the radius of said vortex increases, and withdrawing a residual portion of said slurry.

27. A method according to claim 26 including physically diverting an inner zone of the descending vortex of said slurry at said region where the radius of said vortex increases to enhance theaspirating action.

28. A method according to claim 26 including injecting a high velocity stream of fluid into said region to enhance the aspirating action.

29. A method according to claim 28 including diverting an inner zone of the descending vortex of said slurry at said region where the radius of said vortex increases to further enhance the aspirating action.

30. The method according to claim 28 including varying the flow rate of said stream of fluid injected into said region.

* * * * *